US005389507A

United States Patent [19]

Chen et al.

[11] Patent Number: 5,389,507

[45] Date of Patent: Feb. 14, 1995

[54] REVERSAL ELEMENTS WITH INTERNAL LATENT IMAGE FORMING CORE-SHELL EMULSIONS

[75] Inventors: Keath T. Chen, Rochester; Ingo H. Leubner; Robert A. Arcus, both of Penfield, all of N.Y.

[73] Assignee: Eastman Kodak Company, Rochester, N.Y.

[21] Appl. No.: 999,450

[22] Filed: Dec. 31, 1992

[51] Int. Cl.[6] ..... G03C 1/035

[52] U.S. Cl. ..... 430/567; 430/571

[58] Field of Search ..... 430/567, 571

[56] References Cited

U.S. PATENT DOCUMENTS

| | | | |
|---|---|---|---|
| 2,452,765 | 11/1948 | Knott et al. | 430/571 |
| 2,490,751 | 12/1949 | Hanson, Jr. | 430/571 |
| 3,178,282 | 4/1965 | Luckey et al. | 96/68 |
| 4,082,553 | 4/1978 | Groet | 96/74 |
| 4,435,500 | 3/1984 | Okutsu et al. | 430/419 |
| 4,444,865 | 4/1984 | Silverman et al. | 430/217 |
| 4,469,785 | 9/1984 | Tanaka et al. | 430/572 |
| 4,506,008 | 3/1985 | Sugimoto et al. | 430/502 |
| 4,521,508 | 5/1985 | Sugimoto et al. | 430/567 |
| 4,551,421 | 11/1985 | Sugimoto et al. | 430/509 |
| 4,604,339 | 8/1986 | Sugimoto et al. | 430/244 |
| 4,623,612 | 11/1986 | Nishikawa et al. | 430/567 |
| 4,626,498 | 12/1986 | Shuto et al. | 430/379 |
| 4,643,965 | 2/1987 | Kubota et al. | 430/567 |
| 4,656,120 | 4/1987 | Sugimoto et al. | 430/434 |
| 4,818,671 | 4/1989 | Ohbayashi et al. | 430/550 |
| 4,839,263 | 6/1989 | Miyoshi et al. | 430/384 |
| 4,839,268 | 6/1989 | Bando | 430/567 |
| 4,863,845 | 9/1989 | Murai et al. | 430/567 |
| 4,873,181 | 10/1989 | Miyasaka et al. | 430/523 |
| 4,886,738 | 12/1989 | Deguchi et al. | 430/510 |
| 4,897,340 | 1/1990 | Ohtani et al. | 430/403 |
| 4,994,358 | 2/1991 | Deguchi et al. | 430/571 |
| 4,996,138 | 2/1991 | Murai et al. | 430/522 |
| 5,049,483 | 9/1991 | Yatsuyanagi et al. | 430/597 |
| 5,112,731 | 5/1992 | Miyasaka | 430/567 |
| 5,183,730 | 2/1993 | Yagi | 430/571 |

FOREIGN PATENT DOCUMENTS

| | | |
|---|---|---|
| 0287100 | 4/1988 | European Pat. Off. . |
| 1-092737 | 4/1967 | Japan . |
| 58-095340 | 11/1981 | Japan . |
| 61-245152 | 4/1985 | Japan . |
| 62-169149 | 1/1986 | Japan . |
| 62-254140 | 4/1986 | Japan . |
| 63-002041 | 6/1986 | Japan . |
| 63-058437 | 8/1986 | Japan . |
| 1-059349 | 8/1987 | Japan . |
| 62-254139 | 11/1987 | Japan . |
| 63-038931 | 2/1988 | Japan . |
| 1-216341 | 2/1988 | Japan . |
| 1-216342 | 2/1988 | Japan . |
| 3239437 | 10/1988 | Japan . |
| 2-168245 | 12/1988 | Japan . |
| 2-272444 | 4/1989 | Japan . |
| 2-084639 | 6/1989 | Japan . |
| 3-140945 | 10/1989 | Japan . |
| 3-127045 | 5/1991 | Japan . |
| 3-137632 | 6/1991 | Japan . |

*Primary Examiner*—Janet C. Baxter
*Attorney, Agent, or Firm*—Gordon M. Stewart

[57] ABSTRACT

A reversal photographic element having both a light sensitive layer containing both surface latent image forming silver halide 9rains and internal latent image forming silver halide grains. A method of processing elements of the foregoing type is also provided. The elements exhibit good push processing characteristics with low loss of $D_{max}$.

12 Claims, No Drawings

REVERSAL ELEMENTS WITH INTERNAL LATENT IMAGE FORMING CORE-SHELL EMULSIONS

FIELD OF THE INVENTION

This invention relates to reversal photographic elements particularly useful for push processing, and a method of processing such elements.

BACKGROUND OF THE INVENTION

Color reversal photographic elements typically use a silver halide emulsion, the grains of which form a surface latent image upon exposure to light. The element, following exposure, is processed by first developing in a black and white developer. This develops any exposed silver halide grains. Treatment with a black and white developer is followed by a fogging step which renders any unexposed silver halide developable. Subsequent treatment with a color developer develops the unexposed grains and thereby produces oxidized color developer which then reacts with a dye forming compound (usually a color coupler) to produce dye in unexposed regions of the element. Currently, the particular process which has become a standard for processing reversal films, is by Kodak Process E-6 or substantially equivalent processes made available by other manufacturers.

It will be noted that color reversal elements generally have higher contrasts and shorter exposure latitudes than color negative film. Reversal elements also have a gamma generally between 1.8 and 2.0, and this is much higher than for negative materials. Moreover, such reversal elements do not have masking couplers, and this further differentiates reversal from negative working films.

Color reversal photographic materials though, are often used under insufficient light conditions. In such situations, to obtain useful images in the underexposed areas of the films, the films are often developed for longer than standard times. This extended processing is often referred to as "push processing". Push processing is generally achieved by extending the development time of the first developer (B&W). Another reason for push processing is to modify the response of the element in the low exposure regions. That is, a photographer may want to have higher toe contrast than the normal film/process provides (that is, higher contrast in the higher exposure region of the density versus logE curve of a reversal element). The control of toe contrast can also be achieved by extending first development time (that is, by push processing). Usually, push processing is measured in terms of "stops pushed". Thus, in the case of Kodak process E-6, the normal first (black and white) development time is 6 minutes. However, for a "1 stop push", that time is increased to 8 minutes. For a 2 or 3 stop push, the first development time would be increased to 11 or 13 minutes, respectively.

Push processing of conventional color reversal light sensitive materials can produce several undesirable defects. These include:

1. Sufficient speed increases may not be attained unless first development time is extremely prolonged.

2) Undesirable changes in curve shape may result.

3) The highest density (Dmax, low exposure area) that can be attained may be lowered to a degree where image quality is no longer acceptable.

4) Color mismatch may result from mismatch of the development rates in the red, green, and blue light-sensitive layers of multilayer films.

U.S. Pat. No. 2,996,382 describes a technique of enhanced speed and contrast of iodide containing emulsions by incorporating a combination of unfogged surface latent image silver halide grains and fogged internal latent image silver halide grains in an emulsion layer. U.S. Pat. No. 3,178,282 extends the technique of U.S. Pat. No. 2,996,382 to non-iodide containing emulsions by using solvent containing developers.

U.S. Pat. No. 4,626,498 describes the use of a combination of unfogged surface latent image silver halide and internally fogged silver halide grains (IF) in push processing of color reversal materials. A disadvantage of this technique is that the image density decreased upon push processing (Dmax loss) which accompanied the speed and contrast increase. U.S. Pat. No. 4,886,738 describes a technique aimed to maintain the sensitivity and contrast advantages in push processing without the decrease of maximum density, by using a combination including inhibitors and surface or internally fogged silver halide grains.

U.S. Pat. No. 4,839,268 discloses a color reversal element which uses an emulsion of grains which form a latent image "mainly inside the grain" as stated in the patent. The object of the patent is to provide color reversal materials having good sharpness and a high contrast when first development time is prolonged or is performed with increased temperature.

Other techniques which have been used to enhance push processing are described, for example, in U.S. Pat. No. 5,041,367, which discloses the use of Lanothane and 4-carboxymethyl-4-thiozoline-2-thione to enhance speed gains. U.S. Pat. No. 4,444,865 discloses the use of a combination of internally sensitized core shell type emulsions with other internal latent image forming core-shell emulsions or with internally fogged emulsions, to enhance the covering power of an image in direct positive elements. A combination of surface fogged emulsions with surface latent imaging emulsions is disclosed in U.S. Pat. No. 4,082,553 to improve interimage effects.

Thus it is desirable to provide a method that allows for push processing to obtain a good speed increase in a color reversal film, or to control the curve shape, with relatively low loss of maximum density ($D_{max}$). It is also desirable that such means can allow independent control of the extent of push processing in the individual emulsion layers.

SUMMARY OF THE INVENTION

Applicants have discovered a reversal photographic element which exhibits good push processing speed increases with none, or relatively low, losses in $D_{max}$. Such reversal photographic elements of the present invention comprise a light sensitive layer containing both surface latent image forming silver halide grains and internal latent image forming silver halide grains. Typically, the internal image forming silver halide grains will contain a chemically sensitized core portion and an outer portion which has not been sensitized. The present invention also provides a method of processing such a reversal element by first treating the element with a black and white developer to develop exposed silver halide grains, which developer includes a silver halide solvent, then fogging non-exposed silver halide grains. Following the foregoing, the element is then treated with a color developer. The present invention further provides a method of making a reversal photographic element comprising first forming an emulsion with grains which are primarily surface latent image forming grains, and also forming an emulsion with grains which are primarily internal latent image forming grains, and then providing those emulsions in the element (typically by coating onto a support or onto another layer already on a support).

EMBODIMENTS OF THE INVENTION

Various thicknesses of the shell of the core-shell emulsions can be used. The particular thickness chosen will depend on the strength of the silver halide solvent in the first (black and white) developing solution, the type of silver halide from which the shell is made, the length of time the element will typically be developed in the first developer, as well as the degree of adsorbance of any spectral sensitizing dye, or other addenda, on the core-shell emulsions. That is, where the strength of the silver halide solvent of the first developer is higher, or the time in the developer is to be longer, then a thicker shell will be preferable. On the other hand, where the silver halide of the shell is less soluble, or a strongly adsorbing spectral sensitizing dye is used on the core-shell grains, then a thinner shell will be preferable. For most situations, including processing by process E-6 or similar processes, the shell thickness will be up to 0.15 μm, and preferably up to only 0.12 μm, or 0.08 μm or even only up to 0.06 μm. Most preferably, the shell thickness will be between 0.01 μm to 0.12 μm, and more preferably between 0.01 μm to 0.08 μm, and further preferably between 0.01 μm and 0.06 μm. It will be understood that the foregoing figures represent average values as measured by disc centrifuge.

It will be understood that photographic elements of the present invention preferably do not have, particularly in the same color record (in the case of a color element) or in the element (in the case of a black and white element) any substantial amount of internally fogged grains. By substantial amount means any amount more than would normally be encountered in the preparation of the particular type of grains used in the present invention. Optionally, if there are any such internally fogged grains present, the proportion of such fogged grains is nominal, that is insufficient to give a density of at least 0.50 as measured according to the procedure set out in U.S. Pat. No. 3,178,282, column 2, lines 57 to 67, which patent is incorporated herein by reference.

While the surface latent image forming emulsion and internal latent image forming emulsion may be in separate (usually adjacent) layers, it is preferred that they are in the same layer. To accomplish this, the separate surface latent image forming emulsion and internal latent image forming emulsions are initially prepared. These are preferably then blended before or during coating onto an element portion (that is, a support or another layer which in the element). Such emulsions are "primarily" surface or internal latent image forming emulsions. By primarily is meant that the majority of the grains of the individual emulsions before blending are either surface latent image forming grains (for a primarily surface latent image forming emulsion) or internal latent image forming grains (for the primarily internal latent image forming emulsion). However, it is preferred that each type of emulsion contains no substantial amount of grains of the type primarily present in the other emulsion. In another embodiment, the surface latent image forming emulsion at the very least, does not meet the test for "negative type silver halide grains forming a latent image mainly inside the grain" as described in column 2 of U.S. Pat. No. 4,839,268.

It will be understood that the core and shell composition and size, as well as chemical sensitization of the core, can be widely varied in accordance with established procedures within the spirit of the present invention. Possible types of silver halides and chemical sensitizations are discussed later.

The proportion of surface sensitized silver halide grains to core-shell grains may vary widely, for example may be from 1:20 to 20:1. Preferably such proportion is from 1:10 to 10:1 and more preferably from 1:5 to 5:1. In most situations, the amount of the internally sensitized core-shell grains will not exceed the amount of the surface sensitized grains. As will be seen from the examples below, the best proportion for any particular element of the present invention can readily be determined by varying proportions and measuring the photographic parameters such as the change in speed upon push processing, as well as the decrease in $D_{max}$.

The core-shell grains may additionally be spectrally sensitized with any spectral sensitizing dyes, a great variety of which are well known. The core-shell grains will particularly be sensitized with red or green sensitizing dyes when used in the red or green sensitive layer of a reversal film (in which case, the surface latent image forming grains will also be spectrally sensitized for the same color). However, it will be appreciated that the core-shell grains may also be blue sensitized when used in a blue sensitive layer of a reversal film (in which layer the surface latent image forming grains may or may not, be spectrally sensitized with blue sensitizing dyes). Of course, in a typical color reversal element, the red, blue or green sensitive unit will also contain a dye compound which releases cyan, yellow or magenta dye, respectively, upon reaction with oxidized color developer.

As to the preparation of core-shell emulsions, methods of preparation are well known. For example, internal latent image forming emulsions are described in U.S. Pat. No. 2,456,953 and U.S. Pat. No. 2,592,250. For example, the core may be prepared in the normal manner and chemically sensitized such as described in U.S. Pat. No. 4,444,865 or 4,839,268. An unsensitized shell is then formed by means of Ostwald ripening onto the core as disclosed, for example, in U.S. Pat. No. 3,206,313, and U.S. Pat. No. 4,035,185. In another method, the shell may be formed on the core by direct precipitation onto the sensitized cores, such as described in U.S. Pat. No. 3,761,276, U.S. Pat. No. 3,850,637 and 3,923,513 and U.S. Pat. No. 4,444,865. As described in U.S. Pat. No. 4,444,865, the core-shell grains can also be surface chemically sensitized. However, any surface sensitization is limited to maintain a balance of surface and internal sensitivity favoring the formation of internal latent image sites. Tolerable levels of surface sensitization may vary. In one embodiment, any surface sensitization may be limited to within tolerable limits as set out in U.S. Pat. No. 4,444,865, columns 7 and 8. U.S. Pat. No. 4,444,865 and all other references cited herein, are incorporated in this application by reference.

Dyes of formula I can be prepared according to techniques that are well-known in the art, such as described in Hamer, *Cyanine Dyes and Related Compounds*, 1964 (publisher John Wiley & Sons, New York, N.Y.) and James, *The Theory of the Photographic Process* 4th edition, 1977 (Eastman Kodak Company, Rochester, N.Y.). The amount of sensitizing dye that is useful in the invention may be from 0.001 to 4 millimoles, but is preferably in the range of 0.01 to 4.0 millimoles per mole of silver halide and more preferably from 0.02 to 0.25 millimoles per mole of silver halide. Optimum dye concentrations can be determined by methods known in the art. Formula II compounds can be typically coated at 1/50 to 50 times the dye concentration, or more preferably 1 to 10 times.

The silver halide used in the photographic elements of the present invention may be silver bromoiodide, silver bromide, silver chloride, silver chlorobromide, and the like, of any morphology. The surface latent image grains, the core of the core-shell emulsions, and the core-shell emulsions themselves, can be tabular grains such as disclosed by Wey U.S. Pat. No. 4,399,215; Kofron U.S. Pat. No. 4,434,226; Maskasky U.S. Pat. No. 4,400,463; and Maskasky U.S. Pat. No. 4,713,323; as well as disclosed in allowed U.S. patent application Ser. No. 819,712 (filed Jan. 13, 1992), U.S. patent application Ser. No. 820,168 (filed Jan. 13, 1992), U.S. patent application Ser. No. 762,971 (filed Sep. 20, 1991), U.S. patent application Ser. No. 763,013 (filed Jan. 13, 1992), and pending U.S. patent application Ser. No. 763,030 (filed Sep. 20, 1992). The grain size of the silver halide may have any distribution known to be useful in photographic compositions, and may be either polydispersed or monodispersed. It is preferred though, that internal and external latent image forming emulsions are matched so that the internal speed of the internal latent image forming emulsion (the internally sensitized core-shell emulsion in particular) is the same as the surface speed of the surface latent image forming emulsion to provide the desired push control.

The silver halide grains for the cores and the surface latent image forming grains, may be prepared according to methods known in the art. Those methods include those such as described in *Research Disclosure,* (Kenneth Mason Publications Ltd, Emsworth, Hampshire, UK) Item 308119, December, 1989 (hereinafter referred to as *Research Disclosure I*), and James, *The Theory of the Photographic Process.* These include methods such as ammoniacal emulsion making, neutral or acid emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation. Methods of preparing the core-shell grains from the cores, have already been described above.

The surface latent image forming silver halide grains to be used in the invention may be advantageously subjected to chemical sensitization with compounds such as gold sensitizers (e.g., gold and sulfur) and others known in the art. Compounds and techniques useful for chemical sensitization of silver halide are known in the art and described in *Research Disclosure I* and the references cited therein. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C., as illustrated in *Research Disclosure,* June 1975, item 13452 and U.S. Pat. No. 3,772,031. The cores of the core-shell grains can be similarly chemically sensitized in the manner already described above.

The photographic elements of the present invention, as is typical, provide the two types of silver halide grains in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I.* Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I.* The vehicle can be present in the emulsion in any amount useful in photographic emulsions. The emulsion can also include any of the addenda known to be useful in photographic emulsions.

Spectral sensitizing dyes which can be used on the silver halide in the manner described above, include cyanine dyes, merocyanine dyes, complex cyanine dyes, complex merocyanine dyes, homopolar cyanine dyes, hemicyanine dyes, styryl dyes, and hemioxonol dyes. Of these dyes, cyanine dyes, merocyanine dyes and complex merocyanine dyes are particularly useful.

Any conventionally utilized nuclei for cyanine dyes are applicable to these dyes as basic heterocyclic nuclei. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei can also be substituted.

The merocyanine dyes and the complex merocyanine dyes that can be employed contain 5- or 6-membered heterocyclic nuclei such as pyrazolin-5-one nucleus, a thiohydantoin nucleus, a 2-thioxazolidin-2,4-dione nucleus, a thiazolidine-2,4-dione nucleus, a rhodanine nucleus, a thiobarbituric acid nucleus, and the like.

These sensitizing dyes can be employed individually, and can also be employed in combination. A combination of sensitizing dyes is often used particularly for the purpose of supersensitization. The sensitizing dyes may be present in the emulsion together with dyes which themselves do not give rise to spectrally sensitizing effects but exhibit a supersensitizing effect or materials which do not substantially absorb visible light but exhibit a supersensitizing effect. For example, aminostilbene compounds substituted with a nitrogen-containing heterocyclic group (e.g., those described in U.S. Pat. Nos. 2,933,390 and 3,635,721), aromatic organic acid-formaldehyde condensates (e.g., those described in U.S.

Pat. No. 3,743,510), cadmium salts, azaindene compounds, and the like, can be present. The sensitizing dye compounds and supersensitizers may be added to an emulsion of the silver halide grains and a hydrophilic colloid at any time prior to (e.g., during or after chemical sensitization) or simultaneous with the coating of the emulsion on a photographic element. The resulting sensitized silver halide emulsion may be mixed with a dispersion of a color image-forming coupler immediately before coating or in advance of coating (for example, 2 hours).

Other addenda in the emulsion may include antifoggants, stabilizers, anti-static agents, filter dyes, light absorbing or reflecting pigments, vehicle hardeners such as gelatin hardeners, coating aids, dye-forming couplers, and development modifiers such as development inhibitor releasing couplers, timed development inhibitor releasing couplers, and bleach accelerators. These addenda and methods of their inclusion in emulsion and other photographic layers are well-known in the art and are disclosed in *Research Disclosure I* and the references cited therein. The emulsion may also include brighteners, such as stilbene brighteners.

The emulsion containing the internal and surface latent image forming silver halides, can be coated simultaneously or sequentially with other emulsion layers, subbing layers, filter dye layers, interlayers, or overcoat layers, all of which may contain various addenda known to be included in photographic elements. These include antifoggants, oxidized developer scavengers, antistatic agents, optical brighteners, light-absorbing or light-scattering pigments, and the like. The layers of the photographic element can be coated onto a support using techniques well-known in the art. These techniques include immersion or dip coating, roller coating, reverse roll coating, air knife coating, doctor blade coating, stretch-flow coating, and curtain coating, to name a few. The coated layers of the element may be chill-set or dried, or both. Drying may be accelerated by known techniques such as conduction, convection, radiation heating, or a combination thereof.

Reversal elements of the present invention can be black and white photographic elements which use dyes to provide the shades of black and grey. Preferably, though, the reversal elements are color reversal photographic elements. In particular, the reversal elements of the present invention are multilayer multicolor elements containing layers sensitive to at least two different spectral wavelength ranges on a support. A multilayer color reversal element of the foregoing type preferably possesses at least one red-sensitive silver halide emulsion layer, at least one green-sensitive silver halide emulsion layer and at least one blue-sensitive silver halide emulsion layer, respectively, on a support. The order of these layers can be varied, if desired. Ordinarily, a cyan forming coupler is present in a red-sensitive emulsion layer, a magenta forming coupler is present in a green-sensitive emulsion layer and yellow forming coupler is present in a blue-sensitive emulsion layer, respectively. However, if desired, a different combination can be employed.

The foregoing dye forming couplers are provided in the emulsion typically by first dissolving or dispersing them in a water immiscible, high boiling point organic solvent, the resulting mixture then being dispersed in the emulsion. Suitable solvents include those in European Patent Application 87119271.2. Dye-forming couplers are well-known in the art and are disclosed, for example, in *Research Disclosure I.*

In particular, couplers which form cyan dyes upon reaction with oxidized color- developing agents are described in such representative patents and publications as U.S. Pat. Nos. 2,772,162; 2,895,826; 3,002,836; 3,034,892; 2,747,293; 2,423,730; 2,367,531; 3,041,236; and 4,333,999; and *Research Disclosure I,* Section VII D. Preferably, such couplers are phenols and naphthols.

Couplers which form magenta dyes upon reaction with oxidized color- developing agents are described in such representative patents and publications as: U.S. Pat. Nos. 2,600,788; 2,369,489; 2,343,703; 2,311,082; 3,152,896; 3,519,429; 3,062,653; and 2,908,573; and *Research Disclosure I,* Section VII D. Preferably, such couplers are pyrazolones and pyrazolotriazoles.

Couplers which form yellow dyes upon reaction with oxidized and color-developing agents are described in such representative patents and publications as: U.S. Pat. Nos. 2,875,057; 2,407,210; 3,265,506; 2,298,443; 3,048,194; and 3,447,928; and *Research Disclosure. I,* Section VII D. Preferably, such couplers are acylacetamides such as benzoylacetanilides and pivaloylacetanilides.

Couplers which form colorless products upon reaction with oxidized color-developing agents are described in such representative patents as: UK Patent No. 861,138; U.S. Pat. Nos. 3,632,345; 3,928,041; 3,958,993; and 3,961,959. Preferably, such couplers are cyclic carbonyl-containing compounds which react with oxidized color- developing agents but do not form dyes.

The image dye-forming couplers can be incorporated in photographic elements and/or in photographic processing solutions, such as developer solutions, so that upon development of an exposed photographic element they will be in reactive association with oxidized color-developing agent. In order to incorporate couplers into a silver halide emulsion layer, known methods, including those described in U.S. Pat. No. 2,322,027 can be used. For example, they can be dissolved in a solvent and then dispersed in a hydrophilic colloid. It is also possible to utilize the dispersing method using polymers, as described in Japanese Patent Publication No. 39853/76 and Japanese Patent Application (OPI) No. 59943/76. Of the couplers, those having an acid group, such as a carboxylic acid group or a sulfonic acid group, can be introduced into hydrophilic colloids as an aqueous alkaline solution. Coupler compounds incorporated in photographic processing solutions should be of such molecular size and configuration that they will diffuse through photographic layers with the processing solution. When incorporated in a photographic element, as a general rule, the image dye-forming couplers should be nondiffusible; that is, they should be of such molecular size and configuration that they will not significantly diffuse or wander from the layer in which they are coated.

The color reversal films of this invention are typically multilayer materials such as described in U.S. Pat. No. 4,082,553, U.S. Pat. No. 4,729,943, and U.S. Pat. No. 4,912,024; paragraph bridging pages 37–38. The support and other elements may be those known in the art, for example, see U.S. Pat. No. 4,912,024, column 38, line 37, and references cited therein, and *Research Disclosure I,* Section XVII, and the references described therein.

Photographic elements of the present invention may also usefully include a magnetic recording layer as described in *Research Disclosure,* (Kenneth Mason Publications Ltd, Emsworth, Hampshire, UK) Item 34390, November 1992.

Photographic elements can be exposed to actinic radiation, typically in the visible region of the spectrum, to form a latent image as described in *Research Disclosure I,* Section XVIII, and then processed through reversal processing to form a visible dye image as described in *Research Disclosure I,* Section XIX. As previously described, processing of color reversal materials of the present invention typically entails development with a nonchromogenic developing agent (which will contain a silver halide solvent) to develop exposed silver halide but not form dye, then uniform fogging of the element to render unexposed silver halide developable, and then development with a color-developing agent. Development is typically followed by the conventional steps of bleaching, fixing or bleach-fixing to remove silver and silver halide, washing and drying. Such a reversal process is, for example, the previously mentioned Kodak Process E-6. Process E-6 and other reversal processes are described in *British Journal of Photography Annual* 1988, p. 194–196. As mentioned above, for push processing the time for which the element is exposed to the black and white (that is, non-chromogenic) developer is increased.

The processing temperature is usually chosen from between 18° C. and 50° C., although it may be lower than 18° C. or higher than 50° C. Color developing solutions are usually alkaline aqueous solutions containing color developing agents. As these color developing agents, known primary aromatic amine developing agents, e.g., phenylenediamines such as 4-amino-N,N-diethylaniline, 3-methyl-4-amino-N,N-diethylaniline, 4-amino-N-ethyl-N-b-hydroxyethylaniline, 3-methyl-4-amino-N-ethyl-N-b-hydroxyethylaniline, 3-methyl -4-amino-N-b-methanesulfonamidoethylaniline, 4-amino-3-methyl-N-ethyl-N-b-methoxyethylaniline, etc., can be used to make exhaustive color reversal developers. In addition, the compounds as described in L. F. A. Mason, *Photographic Processing Chemistry,* Focal Press, pages 226 to 229 (1966), U.S. Pat. Nos. 2,193,015 and 2,592,364, Japanese Patent Application (OPI) No. 64933/73, etc., may be used.

The color developing solutions can further contain pH buffering agents such as sulfite, carbonates, borates and phosphates of alkali metals, etc. developing inhibitors or anti-fogging agents such as bromides, iodides or organic anti-fogging agents, etc. In addition, if desired, the color developing solution can also contain water softeners; preservatives such as hydroxylamine, etc.; organic solvents such as benzyl alcohol, diethylene glycol, etc.; developing accelerators such as polyethylene glycol, quaternary ammonium salts, amines, etc; dye forming couplers; competing couplers; fogging agents such a sodium borohydride, etc.; auxiliary developing agents; viscosity-imparting agents; acid type chelating agents; anti-oxidizing agents; and the like.

After color developing, the photographic emulsion layer is usually bleached. This bleach processing may be performed simultaneously with a fix processing, or they may be performed independently. Any fixing solutions which have compositions generally used can be used in the present invention. As fixing agents, thiosulfuric acid salts and thiocyanic acid salts, and in addition, organic sulfur compounds which are known to be effective as fixing agents can be used. These fixing solutions may contain water-soluble aluminum salts as hardeners.

Bleaching agents which can be used include compounds of metals, e.g., iron (III), cobalt (III), chromium (VI), and copper (II) compounds. For example, organic complex salts of iron (III) or cobalt (III), e.g., complex salts of acids (e.g., nitrilotriacetic acid, 1,3-diamino-2-propanoltetraacetic acid, etc.) or organic acids (e.g., citric acid, tartaric acid, malic acid, etc.); persulfates; permanganates; nitrosophenol, etc. can be used. Of these compounds, potassium ferricyanide, iron (III) sodium ethylenediaminetetraacetate, and iron (III) ammonium ethylenediaminetetraacetate are particularly useful. Ethylenediaminetetraacetic acid iron (III) complex salts are useful in both an independent bleaching solution and a monobath bleach fixing solution.

The present invention is further illustrated by the following examples. Note that all silver halide grain (including shell thicknesses) are in μm unless otherwise indicated.

Internally fogged ("IF") and internally sulfur plus gold sensitized emulsions (the core-shell emulsions) were prepared and spectrally sensitized as described below. The internally fogged emulsions are for the purpose of comparison of performance in reversal elements versus the internally sensitized emulsions. Both types of emulsions were individually added to imaging emulsions in color reversal elements. In the coatings, the core/shell (C/S) emulsions or the internally fogged emulsions (either being the "guest" emulsion) replaced part of the imaging emulsion ("host") so that the silver laydown was held constant.

After coating and exposure, the films were developed for 3, 4, 6, 8, and 11 minutes in the first developer (black and white developer) of the Kodak Process E-6. The development rate is defined as the speed difference (measured at a density of 1.0) between 6 and 11 minutes development time in the first developer. The reference is the development rate of the imaging emulsion without the guest emulsion. At the same time, the maximum density (Dmax) was determined. A greater loss of Dmax in the reversal system indicates greater fog of the emulsions. Thus, less loss in Dmax is preferred.

Detailed experimental procedures and photographic results are described below:

A. Preparation of the Basic (Non-Chemically Sensitized) Imaging/Core Emulsion (EMULSION A)

The 4.8%I bromoiodide imaging emulsion (EMULSION A) which was also used as core for the shelled emulsions, was precipitated at a vAg of 15 mV (pAg 8.50) at 70° C. For the first 50% of the precipitation a 90/10 (mole %) bromide/iodide ratio was used (to obtain a small grain emulsion), for the last 50% bromide (without iodide) was used. The crystals had octahedral morphology and their equivalent circular diameter ("ecd") was measured to be 0.151 micrometer (μm) by disccentrifuge (DC).

B. Preparation of the Fogged Emulsion (EMULSION B)

At 40° C., the EMULSION A was diluted with water to 1.0 kg/MAg. The rag was adjusted to 417 mV (pAg 2.90) with 1.0N AgNO3. The pH was adjusted to 9.0 with 1.0N NaOH. The emulsion was held for 15 minutes at 40° C. Then the vAg was adjusted to 105 mV (pAg 7.95) with 1.0N NaBr. The pH to was adjusted to 5.60 with 1.0N HNO3. This fogged emulsion (EMULSION B) was also used to prepare the internally fogged core/- shell emulsions listed in Table II by the shelling procedure D.

C. Preparation of the Sulfur plus Gold Chemically Sensitized Emulsion (EMULSION C)

At 40° C. the EMULSION A was diluted with water to 1.0 kg/MAg. 85.7 mg NaSCN/MAg, 30.6 mgS/MAg (S="sulfur"=Na2S203*5H2O), and 13.1 mgAu/MAg (Au="gold"=KAuC14) were added ("/MAg" means per mole of silver). The temperature was raised from 40° to 68° C. over 15 minutes and was held at this temperature for 5 minutes. Then the temperature was lowered over 15 minutes to 40° C. This emulsion was used to prepare the imaging emulsion after spectral sensitization or to prepare internally sensitized Core/Shell emulsions listed in Table I below.

D. Preparation of Shelled Emulsions

The shelled emulsions listed in Tables I and II were prepared by adding bone gel to the core emulsions, such as EMULSION B or EMULSION C, to give a final ratio (after precipitation) of 80 g gel/MAg. At 40° C. the pH was adjusted to 5.60. The temperature was raised over 15 minutes to 70° C. The vAg was adjusted with NaBr to 15 mV (pAg 8.50). 3.0N AgNO3 and 3.0N NaBr were added with control of the vAg at 15 mV (pAg 8.50) throughout the precipitation. The flowrate of the reactants was controlled to avoid renuclation. The amount of reactants added was adjusted to give the desired shell thicknesses. After the end of precipitation the mixture was cooled to 40 degC. Then the vAg was adjusted to 85 mV (pAg 8.25). Excess salt and water may be removed by known methods, for example, ultrafiltration or any other suitable method. Dimensions provided for all shells below are shell thickness, unless otherwise indicated. The internally sensitized core-shell emulsions (which form an internal latent image) resulting from shelling EMULSION C, are identified as D-1 through D-6 in Table I. The internally fogged core-shell emulsions resulting from shelling EMULSION B, are identified in Table II as E-1 through E-5.

Note that all emulsions listed in Tables I and II are shelled emulsions, other than EMULSION F, EMULSION G and EMULSION H. EMULSION F is the imaging/core emulsion, EMULSION C, described in preceding section C, which has been spectrally sensitized as described below and is being used as a host emulsion. That is, the grains of EMULSION F serve as the surface latent image forming grains in the present invention. Emulsion EMULSION G was prepared by adding the spectral sensitizing dyes indicated in Table I to the non-chemically sensitized EMULSION A (see section A above), for comparison. Emulsion EMULSION H was prepared by adding the indicated spectral sensitizing dyes in Table II to the fogged EMULSION B, as a comparison. Note that only emulsions D-1 to D-6, all in Table I, are internal latent image forming emulsions which can provide photographic elements of the present invention. All other listed emulsions are comparisons.

Spectral sensitization of emulsions was by procedure E below.

E. Preparation of Spectrally Sensitized Emulsions

The various emulsions listed in Tables I and II below were spectrally sensitized by adding the sensitizing dyes identified in the Tables, at equal surface coverage (mole dye/area). The sensitizing dyes were added from solid dye dispersions. However, the mode of dye addition either as a dispersion or from solution, or by some other means, is not critical to the present invention.

Example 1. Green Sensitized Emulsions

A series of internally sensitized (IS) core/shell emulsions, D-1 through D-6, were prepared by shelling EMULSION C (chemically sensitized core), followed by spectral sensitization as indicated in Table I. The grains of the foregoing act as the internal latent image forming grains. Shelling and spectral sensitizations were performed as already described above. The sensitizing dyes used were listed in the Table I below. These are as follows:

GDye-1: Anhydro-5-chloro-9-ethyl-3'-(2-carboxyethyl)-3-(3-sulfopropyl)oxathiacarbocyanine hydroxide, sodium salt;

GDye-2: Anhydro-5,5'-dichloro-9-ethyl-3,3'-di(3-sulfopropyl)oxacarbocyanine hydroxide, sodium salt;

GDye-3: Anhydro-5'-chloro-3,3'-bis(3-sulfopropyl)-naptho[1,2-d]oxazolothiacyanine hydroxide triethylammonium salt.

TABLE I

Internally Chemically Sensitized Core/Shell Emulsions.

| Emulsion | Size, ecd (μm) | Shell (μm) | Spectral Sensitizing Dye (mg/mole Ag*) GDye-1 | GDye-2 | GDye-3 | Core-Shell |
|---|---|---|---|---|---|---|
| F | 0.151 | 0.000 | 293 | 945 | 403 | No |
| G | 0.151 | 0.000 | 293 | 945 | 403 | No |
| D-4 | 0.163 | 0.006 | 271 | 873 | 372 | Yes |
| D-5 | 0.177 | 0.013 | 249 | 804 | 343 | Yes |
| D-1 | 0.197 | 0.023 | 224 | 722 | 308 | Yes |
| D-6 | 0.197 | 0.023 | 224 | 722 | 308 | Yes |
| D-2 | 0.252 | 0.051 | 175 | 565 | 241 | Yes |
| D-3 | 0.392 | 0.121 | 113 | 363 | 155 | Yes |

As described above, EMULSION F is the chemically sensitized imaging/core emulsion, EMULSION C, which has been spectrally sensitized and is used as the host emulsion (surface latent image forming emulsion). Also EMULSION G was prepared by adding sensitizing dyes to the non-chemically sensitized basic emulsion (EMULSION A) for comparison.

A series of internally fogged (IF) core/shell emulsions (E-1 through E-5), as shown in Table II below, were also similarly prepared from the fogged EMULSION B in order to prepare comparative examples. The fogged non-shelled emulsion, EMULSION H, was also prepared by spectrally sensitizing the fogged emulsion, EMULSION B.

TABLE II

Internally Fogged Core/Shell Emulsions.

| Emulsion | Size, ecd (μm) | Shell (μm) | Dyes in mg/mole Ag* GDye-1 | GDye-2 | GDye-3 | Core-Shell |
|---|---|---|---|---|---|---|
| G | 0.151 | 0.000 | 293 | 945 | 403 | No |
| E-4 | 0.164 | 0.007 | 269 | 868 | 370 | Yes |
| E-5 | 0.185 | 0.017 | 239 | 770 | 328 | Yes |
| E-1 | 0.207 | 0.028 | 213 | 687 | 293 | Yes |
| E-2 | 0.290 | 0.069 | 152 | 492 | 210 | Yes |
| E-3 | 0.363 | 0.106 | 122 | 392 | 167 | Yes |

The above emulsions identified in Tables III, IV, V and VI, were coated as single components or as blends and evaluated in a single layer format below, which provides Coatings 1–26 listed in Tables III–VI. The format comprised:

an emulsion layer containing 60 mgAg/ft2, 150 mg/ft2 of a magenta coupler, MCOUP-1 (see structure below), 5.0 g/mole Ag tetraazaindene (TAI) and 200 mg/ft2 gelatine over a Remjet support and overcoated with 90.7 mg/ft2 gelatin hardened with a hardener (note, 1.0 g/m$^2$=85.7 mg/ft$^2$).

MCOUP-1

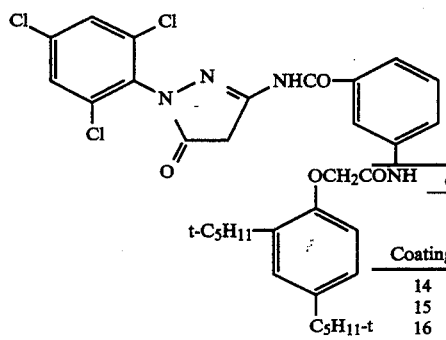

Exposure, Processing, and Evaluation of Above Magenta Coatings

All coatings were exposed with a Tungsten lamp filtered to give a color temperature of 5500 degK plus a KODAK WRATTEN filter No. 12, and were processed in the KODAK Process E-6, with the black and white development (first development) time varied with 3, 4, 6, 8, and 11 minutes. The development time in the first developer (black and white solvent developer) is normally 6 min. An extended development time for push processing is for 11 minutes. The remainder of the E-6 process was not changed. Results for these developments times are listed in the Tables below for Coatings 1–26.

Speeds at density=1.0 and maximum density (Dmax) were compared. The speed of the coating is measured as the inverse of exposure needed to obtain a density of one. The speed is listed in the unit of 0.011 og(1.0/exposure). Speeds and Dmax, both at 6 minutes, are listed in the Tables. The changes in Dmax ("dDmax") and in speed ("dSpeed") from 6 min to 11 min first development time are listed in the Tables below. Note that laydowns of emulsions are all as mg Ag/ft$^2$, unless stated otherwise.

As shown in Table III, EMULSION G, the non-chemically sensitized but spectrally sensitized core emulsion without shell, was added as a guest emulsion to the imaging emulsion, EMULSION F (host) as comparative example. As can be seen from Tables III–VI, the total silver coverage in the coatings was kept constant.

TABLE III

Comparative Example: Addition of the Unsensitized Core to the Image Emulsion.

| Coating | EMULSION F (imaging)* | EMULSION G*# | Speed 6 min | Dmax 6 min | +dSpeed | −dDmax |
|---|---|---|---|---|---|---|
| 14 | 60 | 0 | 131 | 2.79 | 16 | 0.26 |
| 15 | 50 | 10 | 126 | 2.79 | 17 | 0.29 |
| 16 | 40 | 20 | 116 | 2.8 | 17 | 0.29 |
| 17 | 30 | 30 | 102 | 2.78 | 17 | 0.27 |
| 18 | 20 | 40 | 82 | 2.75 | 16 | 0.20 |
| 19 | 10 | 50 | 5 | 2.77 | 18 | 0.23 |
| 20 | 0 | 60 | — | 2.75 | — | 0.22 |

*laydowns in mgAg/ft$^2$; #spectrally sensitized, non-checmically sensitized emulsion The data in Table III shows that the addition of the spectrally sensitized, non-chemically sensitized emulsion, EMULSION G, to the chemically and spectrally sensitized imaging emulsion, EMULSION F, had no significant effect on the push-process results (dSpeed and dDmax). The loss of speed upon adding the guest emulsion in this case is expected due to the significantly lower speed of the non-chemically sensitized versus the chemically sensitized emulsion.

In another comparative example, the surface-fogged and spectrally sensitized emulsion, EMULSION H, which has no shell, was added as a guest emulsion to the imaging emulsion (host). The performance characteristics are listed in Table IV.

TABLE IV

Comparative Example: Addition of the Surface Fogged Emulsion to the Imaging Emulsion.

| Coating | EMULSION F (imaging) | EMULSION H (surface fog) | Speed 6 min | Dmax 6 min | +dSpeed | −dDmax |
|---|---|---|---|---|---|---|
| 21 | 60 | 0 | 131 | 2.79 | 16 | 0.26 |
| 22 | 58 | 2 | 133 | 2.61 | 18 | 0.23 |
| 23 | 55 | 5 | 133 | 2.46 | 20 | 0.57 |
| 24 | 52 | 8 | 132 | 2.34 | 39 | 0.68 |
| 25 | 50 | 10 | 132 | 2.26 | 41 | 0.70 |
| 26 | — | 60 | 127 | 1.76 | — | 1.28 |

*laydowns in mg/ft$^2$

The data in Table IV show that the change in speed upon push processing (dSpeed) is significantly increased by the addition of the surface fogged emulsion, EMULSION H. However, the results also show a significant loss of Dmax (dDmax) on extended development. For the given blend ratio, the speed of the host emulsion is not significantly changed by the addition of this surface fogged emulsion for the six minute development process.

As still another comparative example, the internally fogged core-shell ("C/S") emulsion, E-I, described in Table II, was added as guest to the imaging emulsion, EMULSION F (host). This example was prepared similarly as taught by U.S. Pat. No. 4,626,498.

TABLE V

| Comparative Example: Addition of Internally Fogged Core-Shell Emulsion | | | | | | |
|---|---|---|---|---|---|---|
| Coating | EMULSION F* (imaging) | EMULSION E-1*# (IF, C/S) | Speed 6 min | Dmax 6 min | +dSpeed | −dDmax |
| 1 | 60 | 0 | 131 | 2.79 | 16 | 0.26 |
| 2 | 50 | 10 | 127 | 2.69 | 18 | 0.29 |
| 3 | 40 | 20 | 119 | 2.71 | 22 | 0.50 |
| 4 | 30 | 30 | 112 | 2.65 | 25 | 0.66 |
| 5 | 20 | 40 | 98 | 2.55 | 32 | 0.75 |
| 6 | 10 | 50 | 75 | 2.40 | 48 | 0.83 |
| 7 | 0 | 60 | 81 | 2.30 | 43 | 0.94 |

#0.028 μm shell
*laydowns in mgAg/ft$^2$

The internally fogged emulsion (IF), EMULSION E-1, significantly increases the speed changes (dSpeed) on extended development. However, at the same time a significant loss in Dmax (dDmax) is obtained. At the six minutes standard process, the speed of the host emulsion is significantly decreased as expected from the speed difference between the host and guest emulsion.

Next, as shown in Table VI, the internally chemically sensitized (S/Au) core-shell emulsion, D-1, was spectrally sensitized the same as shown in Table I. The foregoing spectrally sensitized emulsion D-1 is identified as EMULSION D-1A. EMULSION D-1A was added as guest to the imaging emulsion, EMULSION F, as an invention example.

TABLE VI

| Invention Example: Addition of Internally Chemically Sensitized Core-Shell Emulsion | | | | | | |
|---|---|---|---|---|---|---|
| Coating | EMULSION F* (imaging) | EMULSION D-1A*# (IS, C/S) | Speed 6 min | Dmax 6 min | +dSpeed | −dDmax |
| 8 | 60 | 0 | 131 | 2.79 | 16 | 0.26 |
| 9 | 50 | 10 | 132 | 2.65 | 20 | 0.24 |
| 10 | 40 | 20 | 133 | 2.78 | 24 | 0.27 |
| 11 | 30 | 30 | 133 | 2.79 | 25 | 0.19 |
| 12 | 20 | 40 | 129 | 2.76 | 27 | 0.22 |
| 13 | 0 | 60 | 51 | 2.75 | 92 | 0.22 |

#0.023 μm shell
*laydowns in mgAg/ft$^2$

The results in Table VI show that the internally chemically sensitized (IS) core-shell emulsion, D-1A, significantly increases the speed change (dSpeed) upon extended development. At the same time, the change in Dmax (dDmax) is not significantly affected. Significantly, as can be seen from Table VI, blending with the internally chemically sensitized core-shell emulsion gives increased speed changes on push processing, as does blending with the internally fogged (IF) emulsion, but without the loss in Dmax.

Surprisingly, the IS core-shell emulsion did not significantly lower the speed of the host emulsion even up to a blending ratio 20/40 (host/guest, mgAg/ft2) even though the guest emulsion has significantly lower speed than the host emulsion. This is in contrast to the IF emulsion where the blends gave significantly decreased speed.

The addition of potassium iodide (KI) to the above green sensitive emulsion was found to be useful as speed addendum but the push-effect of the IS and IF emulsions remained the same.

Both the IS and the IF emulsions gave increases in granularity when mixed with the imaging emulsion. The IS and IF emulsions are larger than the imaging emulsion, and higher granularity was expected. Using smaller IS and IF emulsions to match the size of the imaging emulsion is expected to reduce the granularity increase.

Next, additional coatings were prepared using EMULSION F (spectrally sensitized forming emulsion), as a host emulsion at 50 mgAg/ft$^2$ with various internally sensitized core-shell emulsions listed in Table I at 10 mgAg/ft$^2$ (guest emulsion). The results upon exposure and processing as described above, are shown below in Table VI-A. An additional series of coatings were prepared using EMULSION F as a host emulsion at 30 mgAg/ft$^2$ with various internally sensitized core-shell emulsions listed in Table I as guest emulsions at 30 mgAg/ft$^2$. The results upon exposure and processing as described above, are listed below in Table VI-B. Note that all emulsions D-2 through D-6 were green spectrally sensitized in the same manner as set out for each in Table I. EMULSION F and EMULSION G, by themselves, are included for comparison. The results from both Table VI-A and VI-B indicate the effect of shell thickness on push processing performance at the two different levels of the internal latent image forming emulsion (guest emulsion).

TABLE VI-A

| Effect of Shell Thickness (Magenta Format) — 10 mgAg/ft$^2$ Guest Emulsion + 50 mgAG/ft$^2$ Host Emulsion | | | | | | |
|---|---|---|---|---|---|---|
| Host Emulsion | Guest Emulsion | Shell Thickness | Relative Speed 6 min | Dmax 6 min | + +dSpeed | − dDmax |
| F | — | — | 0 | 2.97 | 8 | −0.22 |
| G | — | — | −12 | 3.04 | 10 | −0.23 |
| F | D-4 | 0.006 | 27 | 2.88 | 15 | −0.21 |
| F | D-5 | 0.013 | 21 | 2.93 | 22 | −0.27 |
| F | D-6 | 0.023 | 13 | 2.66 | 22 | −0.25 |
| F | D-2 | 0.051 | 2 | 2.84 | 14 | −0.26 |
| F | D-3 | 0.121 | 1 | 2.82 | 12 | −0.23 |

TABLE VI-B

Effect of Shell Thickness (Magenta Format) — 30 mgAg/ft$^2$ Guest Emulsion + 30 mgAG/ft$^2$ Host Emulsion

| Host Emulsion | Guest Emulsion | Shell Thickness | Relative Speed 6 min | Dmax 6 min | + +dSpeed | − dDmax |
|---|---|---|---|---|---|---|
| F | — | — | 0 | 2.97 | 8 | −0.22 |
| G | — | — | −26 | 2.97 | 11 | −0.22 |
| F | D-4 | 0.006 | 83 | 2.82 | 11 | −0.28 |
| F | D-5 | 0.013 | 74 | 2.71 | 24 | −0.28 |
| F | D-6 | 0.023 | 27 | 2.73 | 35 | −0.30 |
| F | D-2 | 0.051 | 17 | 2.87 | 21 | −0.32 |
| F | D-3 | 0.121 | −8 | 2.83 | 12 | −0.24 |

Referring to Table VI-A, at 6 minutes development time the 0.006 to 0.24 μm shell emulsions give significant speed increases versus the host emulsion alone. All of the internally sensitized core-shell emulsions provided increased speed on extended development.

Referring to Table VI-B note that the speed gain on push processing (dSpeed) is significantly increased in comparison to the 10/50 (guest/host) blend used in Table VI-A, for the core-shell emulsions having a 0.013 to 0.015 μm shell.

Example 2: Red sensitized emulsion

The same emulsions described in the Example 1 were evaluated in a red sensitive single layer format.

The series of internally chemically sensitized (IS) core/shell emulsions (D-1 to D-5) listed in Table I was spectrally sensitized using methods described in Section E with red spectral sensitizing dyes. The sensitizing dyes used are listed in Table VII, and were added to the emulsions in the form of solid dye dispersions. However, the mode of dye addition, for example as a dispersion or from solution, is not critical. The host emulsion, EMULSION F, is the spectrally sensitized imaging-/core emulsion, EMULSION C. The red sensitizing dyes were: RDye-1:

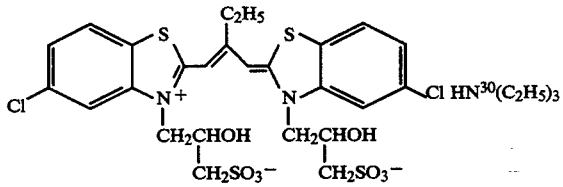

RDye-2: Anhydro-9-ethyl-5,5'-dimethyl-3,3'-di (3-sulfopropyl)thiacarbocyanine hydroxide, triethylamine salt.

TABLE VII

Red Sensitization of Internally (S/Au) Sensitized Core/Shell Emulsions.

| Emulsion | Size, ecd (μm) | Shell (μm) | Core-shell | Dyes in mg/mole Ag RDye-1 | RDye-2 |
|---|---|---|---|---|---|
| F | 0.151 | 0.000 | No | 1991 | 179 |
| D-4 | 0.163 | 0.006 | Yes | 1887 | 170 |
| D-5 | 0.177 | 0.013 | Yes | 1695 | 153 |
| D-1 | 0.197 | 0.023 | Yes | 1462 | 132 |

TABLE VII-continued

Red Sensitization of Internally (S/Au) Sensitized Core/Shell Emulsions.

| Emulsion | Size, ecd (μm) | Shell (μm) | Core-shell | Dyes in mg/mole Ag RDye-1 | RDye-2 |
|---|---|---|---|---|---|
| D-2 | 0.252 | 0.051 | Yes | 1267 | 114 |
| D-3 | 0.392 | 0.121 | Yes | 717 | 65 |

The series of internally fogged (IF) core-shell emulsions (E-1,E-2,E-3,E-4,E-5) as listed in Table II were also similarly red sensitized with the red spectral sensitizing dyes as shown in Table VIII below.

TABLE VIII

Red Sensitization of Internally Fogged Core-Shell Emulsions.

| Emulsion | Size, ecd μm | Shell μm | Core-shell | Dyes in mg/mole Ag* RDye-1 | RDye-2 |
|---|---|---|---|---|---|
| E-4 | 0.164 | 0.007 | Yes | 1770 | 159 |
| E-5 | 0.185 | 0.017 | Yes | 1702 | 153 |
| E-1 | 0.207 | 0.028 | Yes | 1442 | 130 |
| E-2 | 0.290 | 0.069 | Yes | 1032 | 93 |
| E-3 | 0.363 | 0.106 | Yes | 772 | 69 |

The above red spectrally sensitized emulsions, as identified in Tables IX through XI below, were coated as a single component or as blend and evaluated in a single layer format in an emulsion layer containing:

90 mg Ag/ft2, 150 mg/ft2 cyan coupler CCOUP-1 (structure below), 5 g/moleAg tetraazaindine (TAI), 0.1 g/moleAg of 1-(3-acetamidophenyl-mercaptotetrazole), 5.5 mg/moleAg of $Au_2S$, 5.28 g/moleAg of 3,5-disulfocatechol disodium, and 220 mg/ft2 gelatine over a gray gel support and with an overcoat of 90.7 mg/ft2 gelatin hardened with a hardener.

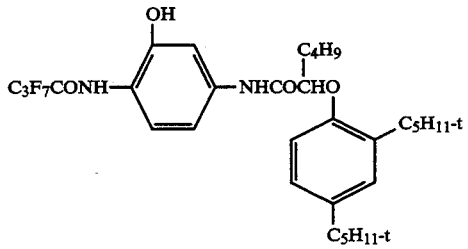

CCOUP-1

Exposure, Processing, and Evaluation of Above Magenta Coatings

The coatings were exposed with 0.04 second duration with a Tungsten lamp filtered to give a color temperature of 3000 degK plus a KODAK WRATTEN filter No.29. These single layers were processed and evaluated as described in Example 1. Table IX shows the results for a comparison of internally sensitized (IS) core-shell (C/S) emulsions versus internally fogged (IF) core-shell emulsions. Note that in each case with the indicated guest emulsion, the amount of guest present was 30 mgAg/ft$^2$ while the amount of host was 60 mgAg/ft$^2$.

TABLE IX

| | Comparison of Internally Sensitized Core-Shell Emulsions versus Internally Fogged Core-Shell Emulsions as Coating Addenda to the Host Emulsion | | | | | |
|---|---|---|---|---|---|---|
| | host emulsion | guest addenda | 6 min Speed | Dmax 6 min | 11 min vs. 6 min +dSpeed | dDmax |
| Check | EMULSION F | — | 0 | 2.64 | 27 | −0.35 |
| Comparison (IF C/S) | EMULSION F | E-5* | 45 | 2.51 | 37 | −0.65 |
| Invention (IS C/S) | EMULSION F | D-5** | 45 | 2.68 | 55 | −0.18 |

*0.017 μm shell; **0.013 μm shell

As can be seen form Table IX, blending the host (surface latent image forming) emulsion with the IS C/S emulsion (D-5) gives a greater speed change with less loss in Dmax on extended processing than blending with the IF emulsion (EMULSION E-5).

The effect of blend ratios of red sensitized emulsions was then investigated with the results for the identified emulsion, as shown in Table X below.

TABLE X

| | Effect of Blend Ratio (Cyan Format) | | | | | | |
|---|---|---|---|---|---|---|---|
| | host emulsion | push addenda | push addenda level | 6 min Speed | 6 min Dmax | 11 min vs. 6 min +dSpeed | dDmax |
| Check | EMULSION F | — | — | 0 | 2.64 | 27 | −0.35 |
| Comparison (IF) | EMULSION F | E-5* | 15 | 24 | 2.61 | 31 | −0.44 |
| Comparison (IF) | EMULSION F | E-5* | 30 | 45 | 2.51 | 37 | −0.65 |
| Invention (IS) | EMULSION F | D-5** | 15 | 23 | 2.67 | 32 | −0.25 |
| Invention (IS) | EMULSION F | D-5** | 30 | 45 | 2.68 | 55 | −0.18 |

*0.017 μm shell; **0.013 μm shell

As can be seen from Table X, blending the host surface latent image forming emulsion with the IS C/S emulsion D-5 at each level shown, gives less loss in Dmax with comparable speed changes on push processing than blending with the IF C/S emulsion E-5.

The results of varying shell thickness on the core shell emulsions indicated in Table XI below, was then investigated. Note that when a guest emulsion was present, the amount was 15 mgAg/ft$^2$ in each case, while the amount of host was 75 mgAg/ft$^2$.

TABLE XI

| | Effect of Shell Thickness (Cyan Format) | | | | | | |
|---|---|---|---|---|---|---|---|
| | host emulsion | push addenda | shell thickness | 6 min Speed | 6 min Dmax | 11 min vs. 6 min +dSpeed | dDmax |
| Check | EMULSION F | — | — | 0 | 2.64 | 27 | −0.35 |
| Comparison (IF) | EMULSION F | E-5 | 0.017 | 24 | 2.61 | 31 | −0.44 |
| Comparison (IF) | EMULSION F | E-2 | 0.069 | 24 | 2.61 | 28 | −0.25 |
| Comparison (IF) | EMULSION F | E-3 | 0.106 | 2 | 2.68 | 22 | −0.27 |
| Invension (IS) | EMULSION F | D-5 | 0.013 | 23 | 2.67 | 32 | −0.25 |
| Invension (IS) | EMULSION F | D-2 | 0.051 | 23 | 2.67 | 25 | −0.26 |
| Invension (IS) | EMULSION F | D-3 | 0.121 | 8 | 2.66 | 28 | −0.36 |

As can be seen from Table XI, the IS C/S emulsions give similar push rate as IF C/S emulsions but have less Dmax drop with suitable shell thickness.

The invention has been described in detail with particular reference to preferred embodiments, but it will be understood that variations and modifications can be effected within the spirit and scope of the invention.

What is claimed is:

1. A reversal photographic element comprising a light sensitive layer containing both surface latent image forming silver halide grains and internal latent image forming silver halide grains and no more than a nominal amount of internally fogged grains, wherein the internal latent image forming grains comprise core-shell grains in which the core has been chemically sensitized, and the surface latent image forming silver halide grains comprise surface chemically sensitized grains.

2. A reversal photographic element according to claim 1 wherein the shell of the core-shell grains has a thickness of up to 0.15 μm.

3. A reversal photographic element according to claim 1 wherein the proportion of surface latent image forming silver halide grains to internal latent image forming silver halide grains is from 1:20 to 20:1.

4. A reversal photographic element according to claim 1 wherein the shell has a thickness of from 0.01 μm to 0.12 μm.

5. A reversal photographic element according to claim 4 wherein the proportion of surface sensitized silver halide grains to core-shell grains is from 1:5 to 5:1.

6. A reversal photographic element according to claim 4 wherein the shell is additionally spectrally sensitized with a spectral sensitizing dye.

7. A reversal photographic element according to claim 4 wherein the surface latent image forming silver halide grains and the shell of the core-shell grains are both green sensitized.

8. A reversal photographic element according to claim 7 wherein the light sensitive layer additionally comprises a magenta dye forming compound which forms magenta dye upon reaction with oxidized developer.

9. A reversal photographic element according to claim 4 wherein the surface latent image forming silver halide grains and the shell of the core-shell grains are both red sensitized.

10. A reversal photographic element according to claim 9 wherein the light sensitive layer additionally comprises a cyan dye forming compound which forms cyan dye upon reaction with oxidized developer.

11. A reversal photographic element according to claim 1 wherein the shell has a thickness of from 0.01 μm to 0.08 μm.

12. A method of making a reversal photographic element comprising forming an emulsion with grains which are primarily surface latent image forming grains, and also forming a separate emulsion with grains which are primarily internal latent image forming grains, wherein the internal latent image grains comprise coreshell grains in which the core has been chemically sensitized, and the surface latent image forming silver halide grains comprise surface chemically sensitized grains, and then blending those two emulsions before or during coating onto an element portion which includes a support, to form a layer containing both emulsions, the layer having no more than a nominal amount of internally fogged grains.

* * * * *